United States Patent [19]

Ostrowsky

[11] 4,381,840

[45] May 3, 1983

[54] THREADED CLOSURE WITH FREE-FLOATING LINER

[75] Inventor: Efrem M. Ostrowsky, Highland Park, Ill.

[73] Assignee: Ethyl Products Company, Richmond, Va.

[21] Appl. No.: 295,576

[22] Filed: Aug. 24, 1981

[51] Int. Cl.[3] ..... B65D 41/04

[52] U.S. Cl. ..... 215/329; 215/350

[58] Field of Search ..... 215/329, 349, 350, 351

[56] References Cited

U.S. PATENT DOCUMENTS

| | | | |
|---|---|---|---|
| 2,039,757 | 5/1936 | Von Till | 215/329 |
| 2,068,389 | 1/1937 | Smith | 215/350 |
| 3,006,493 | 10/1961 | Acton | 215/350 X |
| 3,917,100 | 11/1975 | Dukess | 215/350 X |
| 4,109,815 | 8/1978 | Collins | 215/350 X |

*Primary Examiner*—Donald F. Norton

*Attorney, Agent, or Firm*—Donald L. Johnson; John F. Sieberth; Edgar E. Spielman, Jr.

[57] ABSTRACT

A threaded thermoplastic closure having a free-floating liner is disclosed. To prevent backoff of the closure from a container, studs are provided on the top wall of the closure which anchor the closure to the liner, thus utilizing the resistance to rotation present between the liner and the container lip.

19 Claims, 4 Drawing Figures

THREADED CLOSURE WITH FREE-FLOATING LINER

BACKGROUND OF THE INVENTION

For many years it has been general practice to utilize bottles which are sealed by means of the so-called crown closure to package products which effect a positive pressure in the bottles. Exemplary of such products are carbonated beverages such as beer, soda water and various well known soft drinks. The crown closure is commonly made of tinplate and its fluted skirt is engaged under a peripheral rib which extends around the neck of the bottle in close proximity to its mouth.

The crown closure suffers from two defects, i.e., it requires special tools to remove it from the bottle and it cannot be used to reclose the bottle. This latter disadvantage is important from the consumer acceptance standpoint when the container is of a capacity exceeding the size of a single serving as, with the crown closure, the consumer has no way of easily resealing the container to preserve the remaining product. To overcome this disadvantage, there is presently in the market place a widely used package that enables resealing of the container by the utilization of a closure threadable onto a container having an externally threaded neck. Achievement of the seal is generally effected by the utilization of a liner which is carried adjacent the top of the closure and which is dimensioned to make sealing contact with the container lip upon screwing of the closure to the container. With this threaded system, the consumer reseals the package by merely screwing the closure back onto the container. It has been found that to achieve an initial high fidelity seal, it is desirable to utilize a free-floating disc liner which is carried by the closure. This liner, since it is free-floating, need not necessarily follow the rotation of the closure as it is screwed onto or off of the container. In fact, it has been found highly desirable to optimize the free-floating feature by providing that the liner be of a material such that the liner exhibits a higher coefficient of friction between itself and the container lip than it does between itself and the top of the closure. By having this dissimilarity in the coefficients of friction, the liner will remain stationary with respect to the container lip but will be able to slip with respect to the turning closure as it is threaded onto the container. With the liner slipping vis-a-vis the closure, it does not rotate therewith and the liner is not rubbed around the top of the container lip. Without this slipping, liner-lip rubbing occurs and is disadvantageous as each irregularity in the container lip will cause its particular liner deformation and such deformations will, when the closure reaches its final tightened position, almost always not coincide with the particular lip irregularity which caused the liner deformation. The result of this non-coincidence is deleterious to seal fidelity as the contacting liner-lip sealing surfaces are not in as intimate contact as would be possible if the liner deformation matched the lip irregularity which caused it. However, with the liner slip, the liner is simply pressed downwardly onto the container lip and each liner deformation caused by a particular lip irregularity will coincide with the irregularity. With matching of the liner deformations to the lip irregularities, a highly intimate contact is made and seal fidelity is preserved. While this liner system is beneficial, it does suffer from one drawback, i.e., the system tends to exhibit backoff of the closure from the container. This tendency to backoff is believed to be due to the closure not being able to anchor itself to the liner (due to the built-in slip effect) and therefore not able to resist the unthreading forces which are always present when utilizing thermoplastic closures. This backing off of the closure is most pronounced when the container and closure thread angles are steep, i.e., about seven threads per inch.

Thus, it is an object of this invention to provide a closure which is resistant to backoff but which is also able to utilize a liner sealing system in which the liner exhibits a higher coefficient of friction between itself and the container lip than between itself and the closure.

THE INVENTION

This invention relates to a thermoplastic closure for fitment to a container having a threaded neck terminating in an open mouth. The closure has a circular top wall and an annular downwardly depending skirt, the skirt having about its inside surface a closure thread for cooperation with the neck thread of the container. There is positioned adjacent the top wall of the closure a circular, flexible, liner which has a diameter sufficient to allow it to make sealing contact with the container lip. This liner is freely rotatable with respect to the closure. Emanating from the sidewall inside surface and positioned slightly downward from the closure top wall but above the thread are a plurality of inwardly projecting protuberances. These protuberances block the liner from falling and thus maintain it in a position adjacent the closure top wall. To offer resistance to backoff, the closure of this invention further features a plurality of studs radially displaced from the center axis of the closure so that they will overlie the container lip when the closure is threaded thereon. The height of these studs is such that they will not interfere with the free rotation of the liner as the closure is threaded onto the container. However, the stud height will be sufficient so that, after a period of time, they will penetrate the liner to provide a high resistance to rotation between the closure and the liner. Liner material such as ethylene vinyl acetate copolymer is highly preferred as it is capable of taking a "compression set", i.e., the resistance to penetration is lost with the passage of time and in response to temperature. When an ethylene vinyl acetate copolymer is utilized, it has been found that the stud height is preferably within the range of from about 0.003 to about 0.010 inches.

By having the closure able to obtain an anchoring relationship with the liner, the tendency for the closure to backoff is greatly reduced as the forces promoting backoff must now overcome the resistance to rotation provided by the frictional relationship between the liner and container lip. It is recognized that once this anchoring relationship between the closure and liner is received that replacement of the closure to the container, after it is initially removed, will result in the liner having a tendency to rotate with the closure and that the fidelity of seal achieved upon replacement will not be the same as when the closure was originally threaded to the container. However, this is of little commercial significance as in almost all cases the most concern for the packager is the initial seal achieved by the closure to the container as this initial seal must last a longer time and under more severe conditions than the seal achieved later by the consumer in resealing the package.

Preferably, the studs will be equiangularly spaced about the inside of the closure top wall. This equiangular spacing is not critical but is preferred as such spacing insures good annular deployment of the anchoring sought between the closure and the liner. The thermoplastic closures of this invention can be made of most thermoplastic materials such as polypropylene, high density polyethylene, nylon, polyvinyl chloride, polyethylene terephthalate, etc.

These and other features contributing to satisfaction in use and economy in manufacture will be more fully understood when taken in connection with the following description of preferred embodiments and the accompanying drawings in which identical numerals refer to identical parts and in which.

Figure 1:
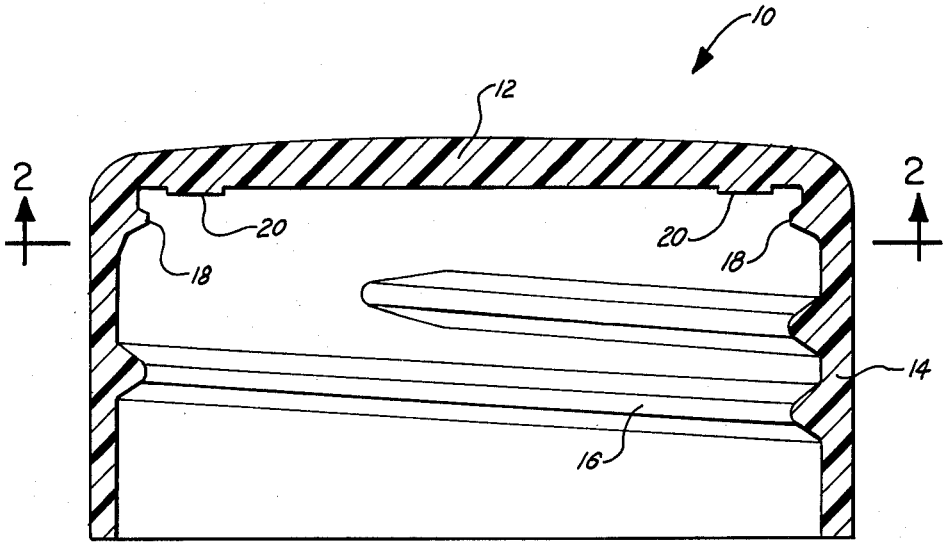
FIG. 1 is a sectional view taken through a closure of this invention.

Referring now to FIGS. 1–4, it can be seen that a closure of this invention is generally designated by the numeral 10. Closure 10 is of a thermoplastic material and has a circular top wall 12. Downwardly depending from top wall 12 is an annular sidewall 14. About the inside surface of sidewall 14 is a helical thread 16 which is dimensioned for cooperation with the container thread.

Downwardly displaced from top wall 12 are chord-shaped protuberances 18 which protrude inwardly of the inside surface of sidewall 14. These protuberances are utilized for maintaining liner 15 at a position adjacent top wall 12. Without protuberance 18, liner 15 would have a tendency to fall away from top wall 12, thereby resulting in inconvenience to the packager and the consumer.

Figure 4:
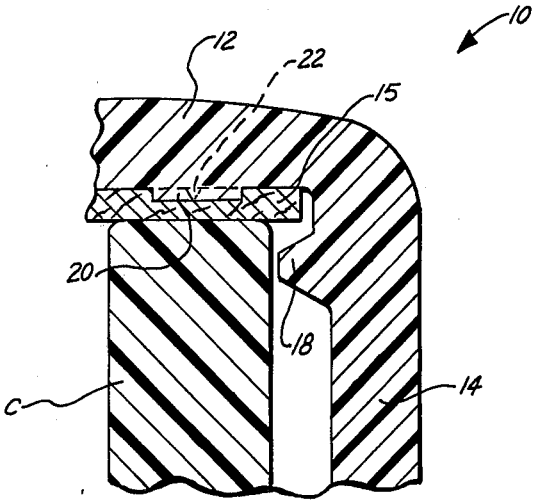
FIG. 4 is an enlarged partial view of the closure shown in FIG. 2 threaded onto a container.
Figure 2:
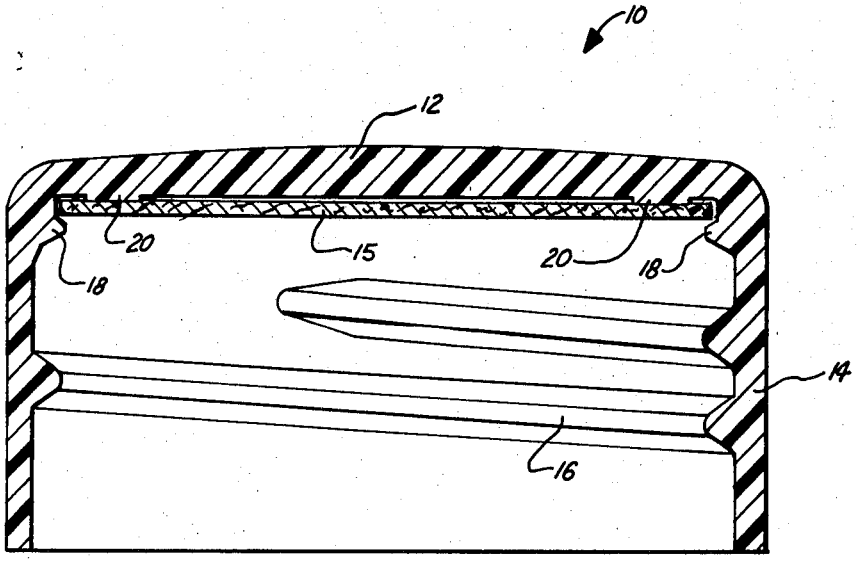
FIG. 2 is a sectional view of the closure shown in FIG. 1, additionally having a liner in place.

Liner 15 can be made of any suitable material capable of effecting a seal when closure 10 is threaded onto the container. As shown in FIG. 4, liner 15 is pressed onto lip 80 of container C when closure 10 is threaded to the container. If the contents of container C are to be consumed, liner 15 should be of a material which is non-toxic and which will not impart an odor or taste to the contents. Also, the material from which liner 15 is made must allow studs 20 to start penetrating its surface after passage of a relatively short period of time, i.e., 5–30 seconds after closure 10 is initially threaded onto container C. To achieve all of these qualities, it has been found that liner 15 is preferably made of ethylene vinyl acetate copolymer. As mentioned previously, the height of studs 20 should be such that they will not penetrate into liner 15 prior to closure 10 being tightened onto container C. The configuration of studs 20 is optional so long as sufficient anchoring is achieved to prevent the backing off of closure 10 from container C. For the embodiment shown in the drawings, studs 20 have a configuration such that they have their long side perpendicular to the direction of rotation. By having a long side so disposed, greater resistance to backoff is provided. Also, studs 20 are pointed at their apex making them triangular in shape when viewed from their ends. Other configurations may be utilized, such as half-round or parabolic shape, the only requirement being that sufficient anchoring be provided by the configuration. In fact, in some cases it may be preferred to have studs 20 slanted away from the direction of rotation when the closure is placed onto the container. Such slanting will provide a ratchet-like action with the studs sliding over the liner when the closure is placed on the container but digging into the liner when the closure undergoes backing-off forces.

Figure 3:
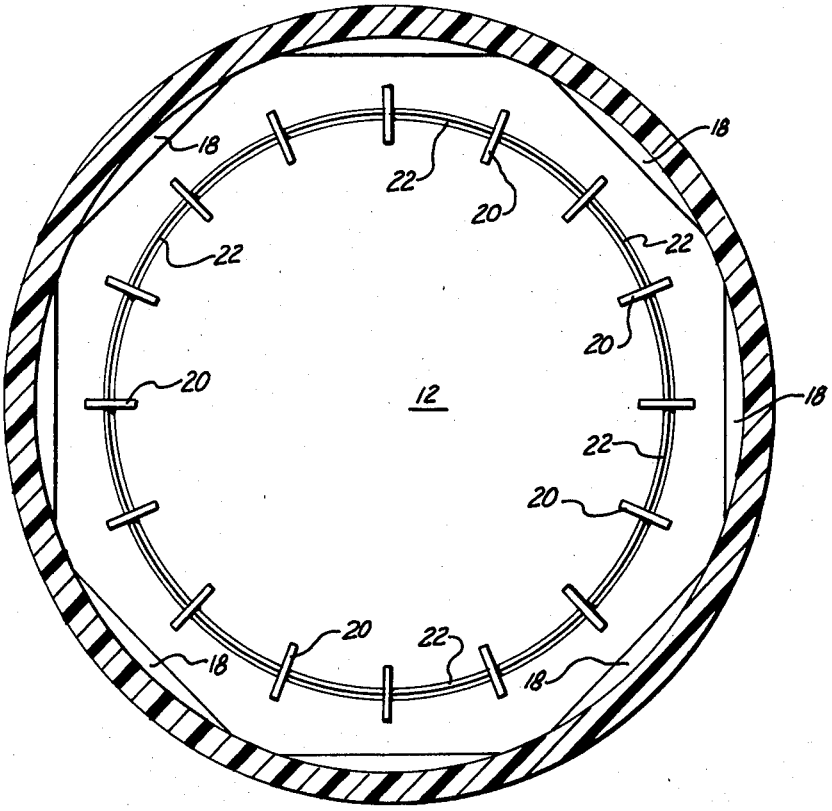
FIG. 3 is a sectional view through section line 3—3 in FIG. 1.

As is shown in FIG. 3, there can additionally be provided an annular rib 22. Annular rib 22 is optional and is utilized to prevent liner 15 from changing axial position as the closure undergoes stress upon its being tightened to container C.

By utilizing studs 20 so that they do not achieve anchoring of closure 10 to liner 15 as the closure is threaded onto container C, liner 15 will be free to rotate when the closure is tightened to the container. However, the height of studs 20 will be sufficient so that when closure 10 is in the tightened position, they will ultimately penetrate the top surface of line 15, thereby anchoring closure 10 to liner 15. Since liner 15 is of a material having a relatively high coefficient of friction between itself and lip 80 of container C, closure 10 will resist backoff rotation at least to a degree approximating the resistance to rotation of liner 15 with respect to container lip 80.

What is claimed:

1. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible liner positioned adjacent said top wall and having a diameter substantially equal to the outside diameter of said lip, said liner being freely rotatable with respect to said closure, and a plurality of studs radially displaced from the center axis of said closure whereby said studs will overlie said container lip when said closure is fitted to said container, said studs having a height such that said studs, prior to the tightening of said closure to said container, do not substantially interfere with said free rotation of said liner but that said studs penetrate the surface of said liner subsequent to said closure being tightened to said container so that said liner is no longer freely rotatable with respect to said closure.

2. The closure of claim 1 wherein said closure additionally has a retaining means about the inside surface of said skirt downwardly positioned below said circular top wall but above said closure thread for preventing said liner from moving down to said closure thread.

3. The closure of claim 2 wherein said closure additionally has an annular rib downwardly projecting from said top wall for engaging said liner to prevent said liner from pulling away from its seal position.

4. The closure of claim 3 wherein said closure is made of polypropylene and said liner is an ethylene-vinyl acetate copolymer.

5. The closure of claim 1 wherein said closure additionally has an annular rib downwardly projecting from said top wall for engaging said liner to resist said liner from moving from its axial position.

6. The closure of claim 1 wherein said closure is made of polypropylene.

7. The closure of claim 6 wherein said liner is an ethylene-vinyl acetate copolymer.

8. The closure of claim 1 wherein said liner is ethylene-vinyl acetate copolymer.

9. The closure of claim 1 wherein said studs each have a configuration such that, when viewed from their ends, they are triangular in shape.

10. The closure of claim 9 wherein said studs have a rectangular shape at their base, and said studs have their long axis perpendicular to the direction of closure rotation.

11. The closure of claim 19 wherein said closure is made of polypropylene and said liner is an ethylene-vinyl acetate copolymer.

12. The closure of claim 11 wherein said closure additionally has a retaining means about the inside surface of said skirt downwardly positioned below said circular top wall but above said closure thread for preventing said liner from moving down to said closure thread.

13. The closure of claim 12 wherein said closure additionally has an annular rib downwardly projecting from said top wall for engaging said liner to resist said liner from moving from its axial position.

14. The closure of claim 1 wherein said studs have a height within the range of from about 0.003 to about 0.010 inches.

15. The closure of claim 14 wherein said studs each have a configuration such that, when viewed from their ends, they are triangular in shape.

16. The closure of claim 15 wherein said liner is an ethylene-vinyl acetate copolymer.

17. The closure of claim 16 wherein said closure is of polypropylene.

18. The closure of claim 17 wherein said closure additionally has a retaining means about the inside surface of said skirt downwardly positioned below said circular top wall means but above said closure thread for preventing said liner from moving down to said closure thread.

19. The closure of claim 18 wherein said closure additionally has an annular rib downwardly projecting from said top wall for engaging said liner to resist said liner from moving from its axial position.

* * * * *

UNITED STATES PATENT AND TRADEMARK OFFICE

CERTIFICATE OF CORRECTION

PATENT NO. : 4,381,840

DATED : May 3, 1983

INVENTOR(S) : EFREM M. OSTROWSKY

It is certified that error appears in the above-identified patent and that said Letters Patent is hereby corrected as shown below:

Column 2, lines 58 and 59, reads "received", should read --achieved--

Column 5, line 1, of Claim 11, reads "of Claim 19", should read --of Claim 10--

Signed and Sealed this

Ninth Day of August 1983

[SEAL]

*Attest:*

*Attesting Officer*

GERALD J. MOSSINGHOFF

*Commissioner of Patents and Trademarks*